US007800569B2

(12) United States Patent
Chen et al.

(10) Patent No.: US 7,800,569 B2
(45) Date of Patent: Sep. 21, 2010

(54) LIQUID CRYSTAL DISPLAY CAPABLE OF COMPENSATING FEED-THROUGH VOLTAGE AND DRIVING METHOD THEREOF

(75) Inventors: Shyh-feng Chen, Hsin-Chu (TW); Kuei-sheng Tseng, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 771 days.

(21) Appl. No.: 11/689,131

(22) Filed: Mar. 21, 2007

(65) Prior Publication Data

US 2008/0042949 A1 Feb. 21, 2008

(30) Foreign Application Priority Data

Aug. 18, 2006 (TW) ..... 95130543 A

(51) Int. Cl.
*G09G 3/36* (2006.01)

(52) U.S. Cl. ..... 345/92; 345/95

(58) Field of Classification Search ..... 345/86–95; 349/42

See application file for complete search history.

(56) References Cited

U.S. PATENT DOCUMENTS 4,890,097 A * 12/1989 Yamashita et al. ..... 345/93
4,936,656 A * 6/1990 Yamashita et al. ..... 349/8
4,955,697 A * 9/1990 Tsukada et al. ..... 349/38
5,818,407 A * 10/1998 Hori et al. ..... 345/92
2003/0123006 A1 * 7/2003 Jeong et al. ..... 349/139

* cited by examiner

*Primary Examiner*—Chanh Nguyen
*Assistant Examiner*—Pegeman Karimi

(57) ABSTRACT

A liquid crystal display includes a gate driver, a source driver, a plurality of scan lines, a plurality of data lines, and a plurality of pixel units arranged in an array. The gate driver is used for generating scan signals. The scan signals include a first voltage level, a second voltage level greater than the first voltage level, and a third voltage level less than the first voltage level. The source driver is used for generating data signals. The plurality of scan lines includes a first scan line, a second scan line, and a third scan line, for delivering the scan signals. The plurality of data lines includes a first data line for delivering the data signals. Each pixel unit includes a first pixel electrode, a first transistor, a second pixel electrode, a second transistor, and a level adjustment unit.

19 Claims, 9 Drawing Sheets

LIQUID CRYSTAL DISPLAY CAPABLE OF COMPENSATING FEED-THROUGH VOLTAGE AND DRIVING METHOD THEREOF

BACKGROUND OF INVENTION

1. Field of the Invention

The present invention relates to a liquid crystal display (LCD), more particularly, to a liquid crystal display capable of compensating feed-through voltage.

2. Description of the Prior Art

With a rapid development of monitor types, novelty and colorful monitors with high definition, e.g., liquid crystal displays (LCDs), are indispensable components used in various electronic products such as monitors for notebook computers; personal digital assistants (PDA), digital cameras, and projectors. The demand for the novelty and colorful monitors has increased tremendously.

As the number of pixels increase to improve definition of an active-matrix-type LCD, the following problems have arisen. The number of data signal lines and scan lines have significantly increased along with the number of pixels and the number of driver ICs. This has increased cost and complexity. Many solutions have been proposed to reduce the number of circuit components. For example, an electric potential can be supplied from one data signal line to two or more adjacent pixels in a row. The signal for each pixel is provided in a time-division multiplexed manner to reduce the number of driver ICs. With reference to, for example, U.S. Pat. Publish No. 20050083319A1, U.S. Pat. No. 6,414,665 and U.S. Pat. No. 6,476,787, though, these design can reduce the number of driver ICs by half, but feed-through voltage effect causes voltages applied on two pixel electrodes of a pixel unit are different, thereby reducing display quality.

Please refer to FIG. 1 and FIG. 2. FIG. 1 is a circuit diagram showing a pixel unit of the liquid crystal display according to the prior art. FIG. 2 is a timing diagram showing scan signals on the scan lines depicted in FIG. 1. The liquid crystal display 10 contains a gate driver 14, a source driver 16 and a plurality of pixel units 20 arranged in an array. Each pixel unit 20 includes a first pixel An and a second pixel Bn. In a time period T5-T6, the gate driver 14 outputs scan signals on scan lines Gn, Gn+1 at high voltage level to turn on the transistors 11, 12, 21. The source driver 16 sends data signal to the pixel electrodes An and An+1 via the transistors 11 and 21. Meanwhile, the second pixel Bn receives the data signal via the pixel electrode An+1, because the transistor 12 is turned on. In the time period T6-T7, the scan signal on the scan line Gn is at high voltage level to turn on the transistors 11 and 12, while the scan signal on the scan line Gn+1 is at low voltage level to turn off the transistor 21, so that the voltage applied on the pixel electrode An equals to data signal, but the voltage applied on the pixel electrode Bn is not as the same as the data signal due to the reason that the transistor 21 is turned off. Furthermore, while the transistor is turned off, a voltage of the pixel electrode is varied due to parasitic capacitor between the gate and the source of the transistor. That is, at the time T6 which the scan signal on the scan line Gn+1 is varied from the high voltage level to the low voltage level, a voltage drop $V_{fB1}$ of the pixel electrode Bn results from a parasitic capacitor $C_{gd2}$, and the voltage drop $V_{fB1}$ is named as "feed-through voltage". Similarly, at the time T7 which the scan signal on the scan line Gn is varied from the high voltage level to the low voltage level, turning on the transistors 11 and 12, feed-through voltages $V_{fB2}$, $V_{fA}$ of the pixel electrode Bn and the pixel electrode are induced by parasitic capacitors Cgd1, Cgd2 of the transistors 11, 12, as shown in FIG. 3. Then, before the scan signal on the scan line Gn returns to the high level, the source driver 16 will not provide data signal to the pixel electrode An and the pixel electrode Bn. After the time T7, the effect of the feed-through voltages of the pixel electrode An and the pixel electrode Bn remains. Because the feed-through voltage ($V_{fB1}$+$V_{fB2}$) of the pixel electrode Bn is greater than the feed-through voltage ($V_{fA}$) of the pixel electrode An, the grey levels displayed by the pixel electrode An and the pixel electrode Bn are different, accordingly.

SUMMERY OF THE INVENTION

Accordingly, an objective of the present invention is to provide a liquid crystal display and its related driving method to compensate feed-through voltage, solving aforementioned problem of prior art.

Briefly summarized, the claimed invention provides a liquid crystal display. The liquid crystal display comprises a gate driver, a source driver, a plurality of scan lines, a plurality of data lines, and a plurality of pixel units arranged in an array. The gate driver is used for generating scan signals. The scan signals comprise a first voltage level, a second voltage level greater than the first voltage level, and a third voltage level less than the first voltage level. The source driver is used for generating data signals. The plurality of scan lines comprise a first scan line, a second scan line, and a third scan line, and are used for delivering the scan signals. The plurality of data lines comprises a first data line, and are used for delivering the data signals. Each pixel unit comprises a first pixel electrode, a first transistor, a second pixel electrode, a second transistor, and a level adjustment unit. The first transistor which is electrically coupling the first pixel electrode, the first data line, and the second scan line is used for conducting the data signals from the first data line to the first pixel electrode when the scan signal from the second scan line is at the second voltage level. The second transistor, electrically coupling the second pixel electrode and a first pixel electrode of a pixel unit which is electrically coupled to the third scan line and the first data line. The second transistor is used for conducting the data signals, through the first pixel electrode of the pixel unit which is electrically coupled to the third scan line and the first data line, to the second pixel electrode, when scan signals from the second scan line and the third scan line are at the second voltage level. The level adjustment unit is used for adjusting a voltage applied on the second pixel electrode, when the scan signal from the second scan line is at the second voltage level, and when a scan signal from the first scan line is varied from the third voltage level to the first voltage level.

In one aspect of the present invention, the level adjustment unit which is electrically coupled to the second pixel electrode and the first scan line is a capacitor.

In another aspect of the present invention, the level adjustment unit is used for adjusting the voltage applied on the second pixel electrode in response to a capacitance of the level adjustment unit, when the scan signal from the second scan line is at the second voltage level, and when the scan signal from the first scan line is varied from the third voltage level to the first voltage level.

According to the claimed invention, a liquid crystal display, comprises a gate driver, a source driver, a plurality of scan lines, a plurality of data lines, and a plurality of pixel units arranged in an array. The gate driver is used for generating scan signals. The scan signals comprise a first voltage level, second voltage level greater than the first voltage level, and a third voltage level less than the first voltage level. The source driver is used for generating data signals. The plurality of scan lines comprise an first scan line, an second scan line, and an third scan line, for delivering the scan signals. The plurality of data lines comprise a first data line for delivering the data signals. Each pixel unit comprises a first pixel electrode, a first transistor, a second pixel electrode, a second transistor, a first level adjustment unit, and a second level adjustment unit. The first transistor, electrically coupling the first pixel electrode, the first data line and the second scan line, is used for conducting the data signals from the first data line to the first pixel electrode when the scan signal from the second scan line is at the second voltage level. The second transistor is electrically coupling the second pixel electrode and a first pixel electrode of a pixel unit which is electrically coupled to the third scan line and the first data line. The second transistor is used for conducting the data signals through the first pixel electrode of the pixel unit which is electrically coupled to the third scan line and the first data line, to the second pixel electrode, when the scan signals from the second scan line and the third scan line are at the second voltage level. The first level adjustment unit is used for adjusting the voltage applied on the second pixel electrode, when the scan signal from the second scan line is at the third voltage level, and when a scan signal from the first line is varied from the third voltage level to the first voltage level. The second level adjustment unit is used for adjusting the voltage applied on the first pixel electrode, when the scan signal from the second scan line is at the third voltage level, and when the scan signal from the first scan line is varied from the third voltage level to the first voltage level.

In one aspect of the present invention, the first level adjustment unit is electrically coupled to the second pixel electrode and the first scan line. Moreover the first level adjustment unit is a capacitor. The first level adjustment unit is used for adjusting the voltage applied on the second pixel electrode in response to a capacitance of the first level adjustment unit, when the scan signal from the second scan line is at the third voltage level, and when the scan signal from the first scan line is varied from the third voltage level to the first voltage level.

In another aspect of the present invention, the second level adjustment unit is electrically coupled to the first pixel electrode and a gate of the second transistor of the pixel unit which is electrically coupled to the first scan line and the first data line. Further, the second level adjustment unit is a capacitor. The second level adjustment unit is used for adjusting the voltage applied on the first pixel electrode in response to a capacitance of the second level adjustment unit, when the scan signal from the second scan line is at the third voltage level, and when the scan signal from the first scan line is varied from the third voltage level to the first voltage level According to the claimed invention, a method of driving a liquid crystal display is provided. The liquid crystal display comprises a plurality of scan lines, a plurality of data lines, and a plurality of pixel units arranged in an array. The plurality of scan lines comprise a first scan line, a second scan line, and a third scan line, and the plurality of data lines comprise a first data line. Each pixel unit comprises a first pixel electrode and a second pixel electrode. The method comprises the step of: providing scan signals, the scan signals comprising a first voltage level, a second voltage level greater than the first voltage level, and a third voltage level less than the first voltage level; conducting the data signal to the second electrode of a pixel unit which is electrically coupled to the second scan line and the first data line, through a first pixel electrode of a pixel unit which is electrically coupled to the first scan line and the first data line to the second pixel electrode, when the scan signals from the second scan line and the third scan line are at the second voltage level; and adjusting a voltage applied on the second pixel electrode in response to a capacitance of a capacitor electrically coupled to the second pixel electrode of the pixel unit which is electrically coupled to the second scan line and the first data line, when the scan signal from the second scan line is at the second voltage level, and when the scan signal from first second line is varied from the third voltage level to the first voltage level.

According to the claimed invention, a method of driving a liquid crystal display is provided. The liquid crystal display comprises a plurality of scan lines, a plurality of data lines, and a plurality of pixel units arranged in an array. The plurality of scan lines comprise a first scan line, a second scan line, and a third scan line, and the plurality of data lines comprise a first data line. Each pixel unit comprises a first pixel electrode and a second pixel electrode. The method comprises the steps of: providing scan signals, the scan signals comprising a first voltage level, a second voltage level greater than the first voltage level, and a third voltage level less than the first voltage level; conducting the data signal to the second electrode of a pixel unit which is electrically coupled to the second scan line and the first data line, through a first pixel electrode of a pixel unit which is electrically coupled to the first scan line and the first data line to the second pixel electrode, when the scan signals from the second scan line and the third scan line are at the second voltage level; and adjusting voltages applied on the first pixel electrode and the second pixel electrode of the pixel unit which is electrically coupled to the second scan line and the first data line, in response to a first capacitor electrically coupled to the first pixel electrode and a second capacitor electrically coupled to the second pixel electrode, respectively, when the scan signal from the second scan line is at the second voltage level, and when the scan signal from the first scan line is varied from the third voltage level to the first voltage level.

The disclosed inventions will be described with references to the accompanying drawings, which show important example embodiments of the inventions and are incorporated in the specification hereof by related references.

DETAILED DESCRIPTION OF THE INVENTION

Figure 1:
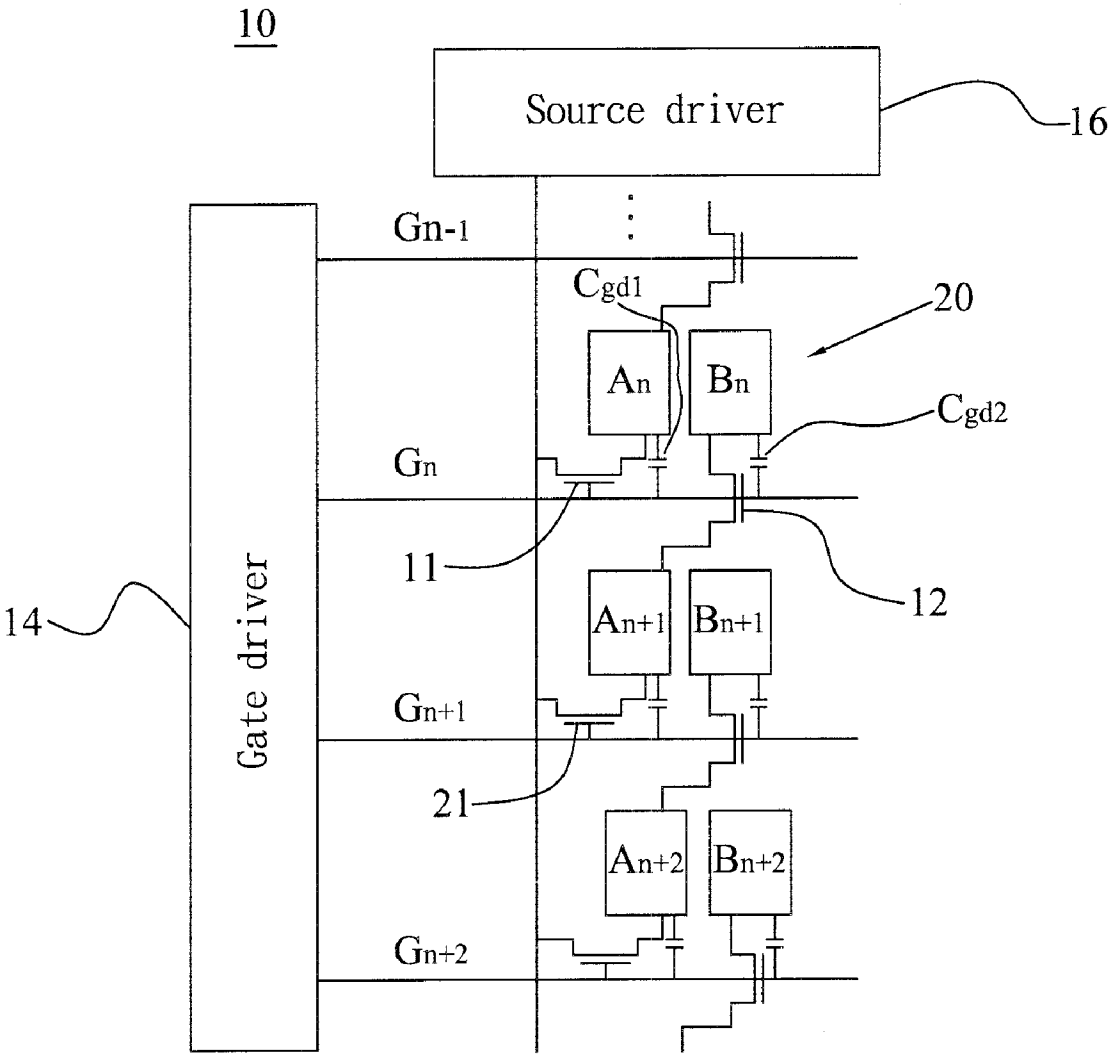
FIG. 1(PRIOR ART)
FIG. 1 is a circuit diagram showing a pixel unit of the liquid crystal display according to the prior art.
Figure 2:
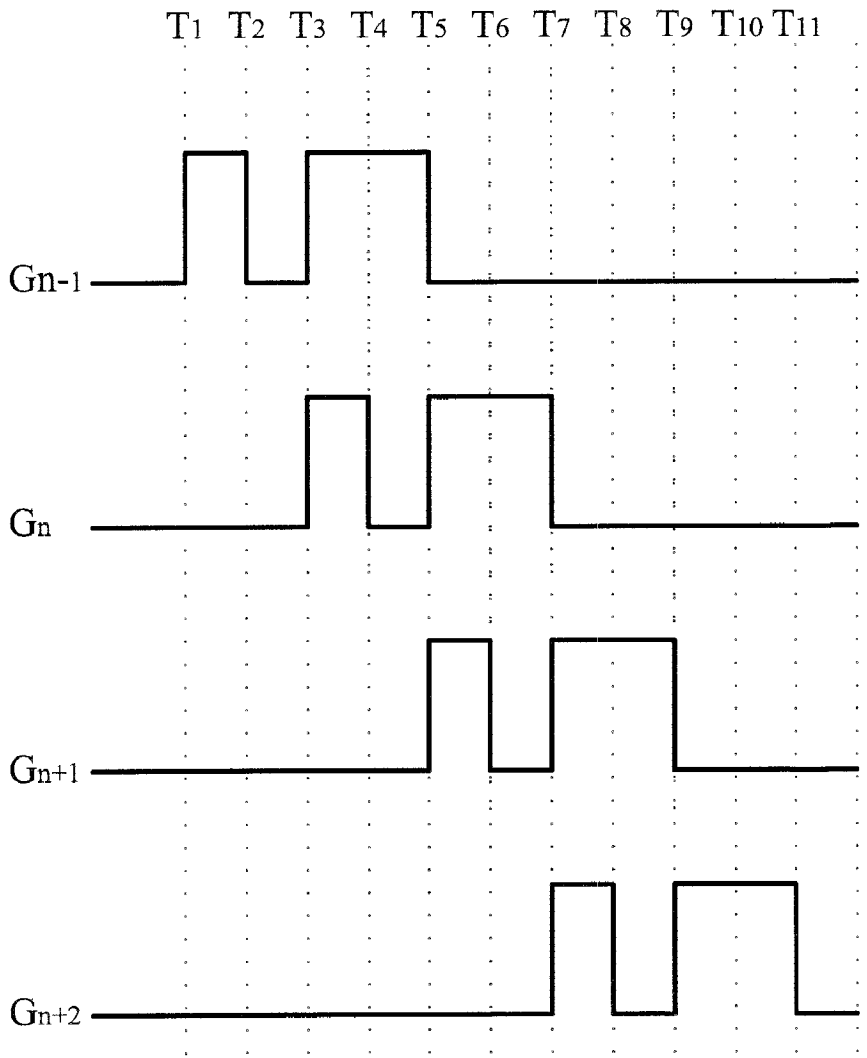
FIG. 2(PRIOR ART)
FIG. 2 is a timing diagram showing scan signals on the scan lines depicted in FIG. 1.
Figure 3:
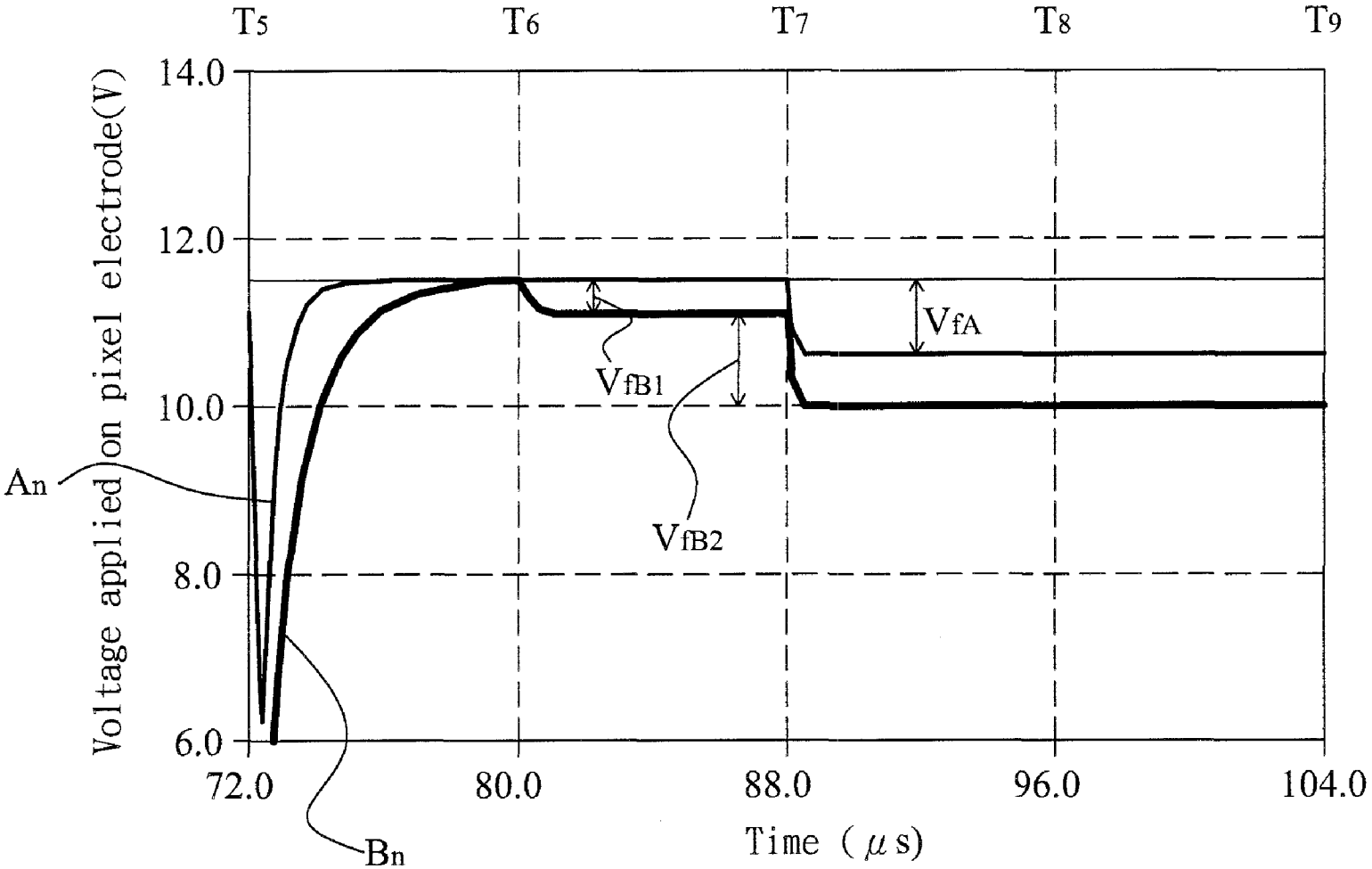
FIG. 3(PRIOR ART)
FIG. 3 illustrates a relationship of voltages applied on the pixel electrode An and the pixel electrode Bn of the pixel unit depicted in FIG. 1.
Figure 4:
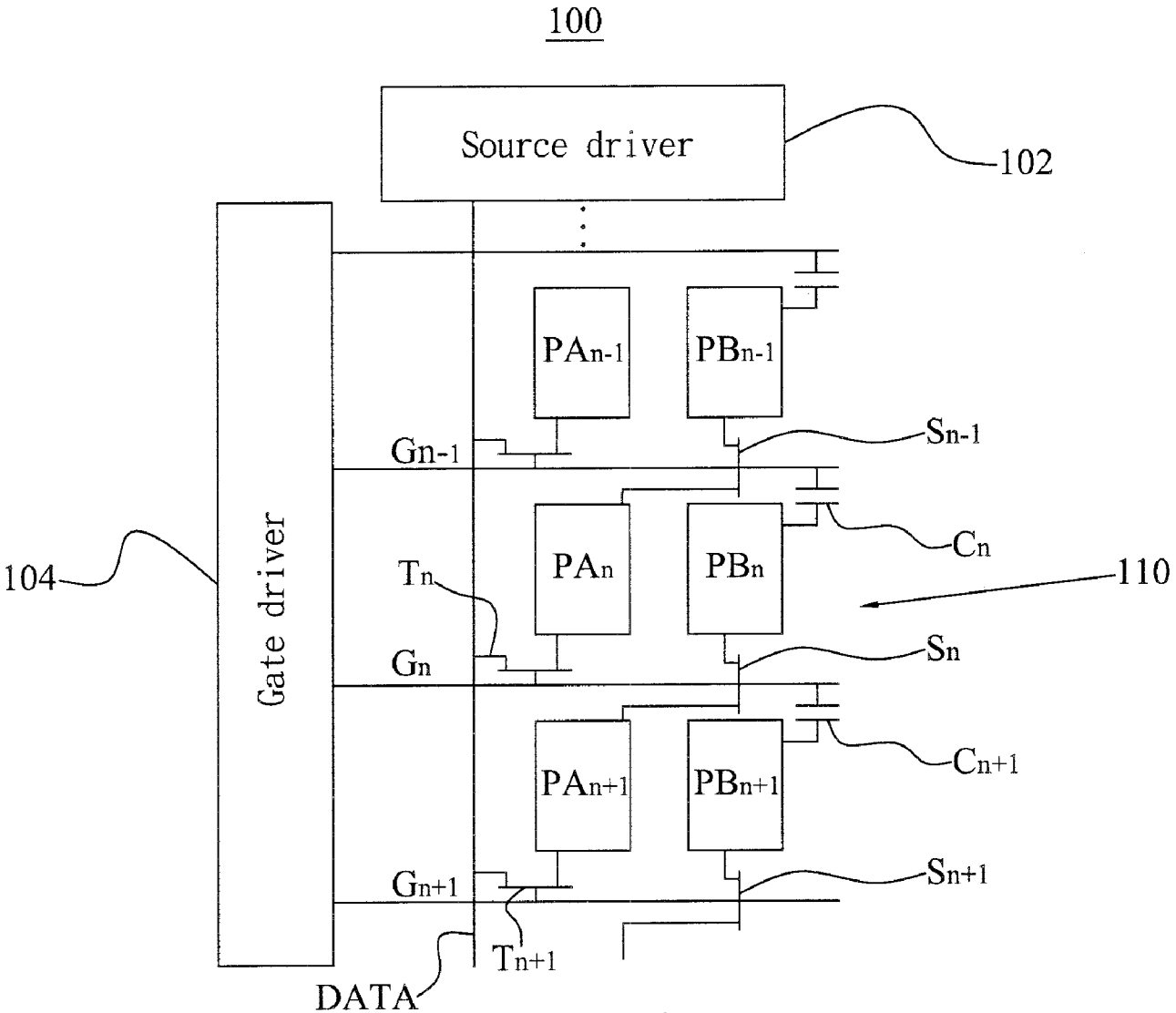
FIG. 4 is a circuit diagram of a liquid crystal display according to a first embodiment of the present invention.
Figure 5:
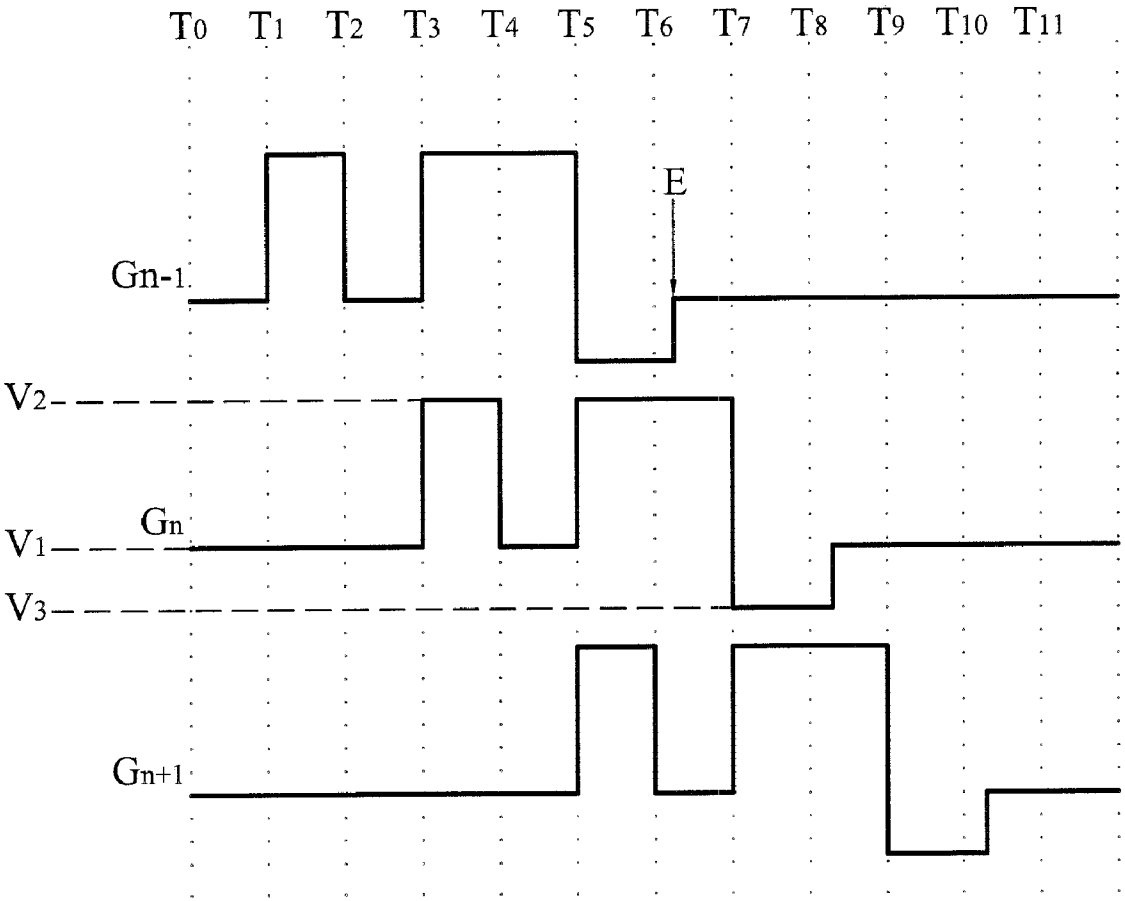
FIG. 5 is a timing diagram showing a scan signal generated by the gate driver depicted in FIG. 4.

With reference to FIG. 4 and FIG. 5, FIG. 4 is a circuit diagram of a liquid crystal display 100 according to a first embodiment of the present invention, and FIG. 5 is a timing diagram showing a scan signal generated by the gate driver depicted in FIG. 4. A liquid crystal display 100 comprises a source driver 102, a gate driver 104 and a plurality of the pixel units 110. The plurality of pixel units 110 are arranged in an array. Each pixel unit 110 comprises a first pixel electrode $PA_n$, a second pixel electrode $PB_n$, a first transistor $T_n$, a second transistor $S_n$ and a level adjustment unit. The gate driver 104 can generate a scan signal in characteristic of at least three voltage levels of which a second voltage level $V_2$ is greater than a first voltage level $V_1$ and a third voltage level $V_3$ is less than the first voltage level $V_1$. The level adjustment unit can be a capacitor $C_n$.

Figure 6:
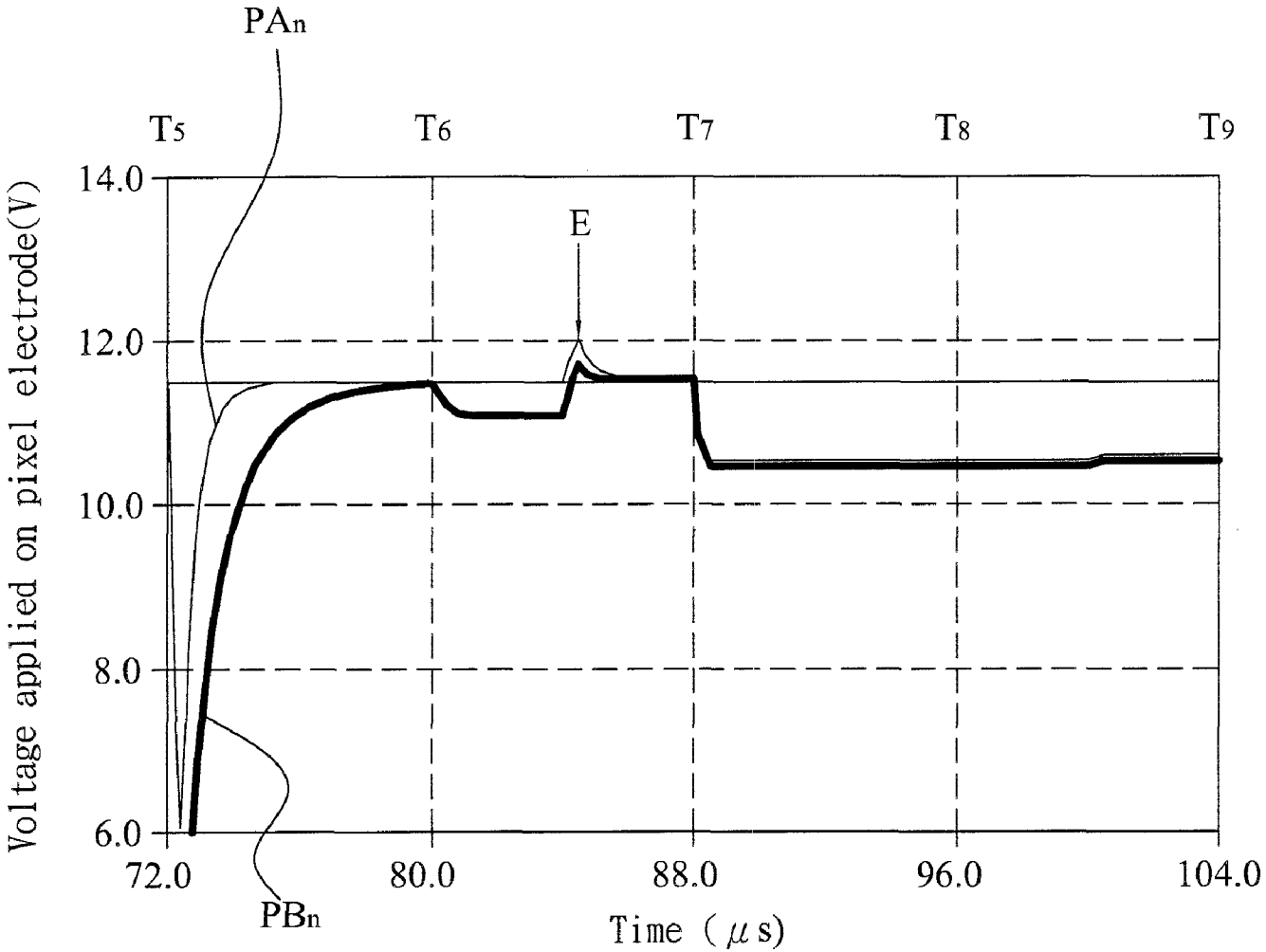
FIG. 6 illustrates a relationship of voltages applied on the first pixel electrode $PA_n$ and the second pixel electrode $PB_n$ of the pixel unit depicted in FIG. 4.

With reference from FIG. 4 to FIG. 6, FIG. 6 illustrates a relationship of voltages applied on the first pixel electrode $PA_n$ and the second pixel electrode $PB_n$ of the pixel unit depicted in FIG. 4. First, in the time period T5-T6, the transistors $T_n$, $S_n$, $T_{n+1}$ are all turned on due to the scan signals at the second voltage level $V_2$ generated by the gate driver 104 through the scan lines $G_n$, $G_{n+1}$. Meanwhile, the scan signal on the scan line $G_{n-1}$ is at the third voltage level $V_3$, so the transistor $S_{n-1}$ is turned off. Therefore, data signal generated from the source driver 102 is delivered to the first pixel electrodes $PA_n$ and $PA_{n+1}$ via data line DATA, and charges the second pixel electrode $PB_n$ since the transistor $S_n$ is turned on. As such the first pixel electrode $PA_n$ and the second pixel electrode $PB_n$ are simultaneously fed by the same data signal. At the same time, the storage capacitor $C_n$ is charged due to a voltage difference across its two ends.

In the time period T6-T7, the scan signal on the scan line $G_n$ remains at the second voltage level $V_2$ to switch on the transistors $T_n$, $S_n$, whereas the scan signal on the scan line $G_{n+1}$ is switched to the first voltage level $V_1$, thereby turning off the transistor $T_{n+1}$. As can been seen in FIG. 6, at the time point T6, a voltage drop of the second pixel electrode $PB_n$ is induced by a feed-through voltage effect. In a duration of the time period T6-T7, because the scan signal on the scan line $G_{n-1}$ is varied from the third voltage level $V_3$ to the first voltage level $V_1$ (at the moment indicated by the arrow E shown in FIG. 5 and FIG. 6), and charge stored in the capacitor $C_n$ is constant, the voltage level of the second pixel electrode $PB_n$ raises as a rise of voltage level of the scan signal on the scan line $G_{n-1}$. Accordingly, a proper capacitance of capacitor $C_n$ can adjust the voltage level of the first pixel electrode $PA_n$ as the same as that of the second pixel electrode $PB_n$.

Next, in the time period T7-T8, the scan signal on the scan line $G_{n-1}$ holds at the first voltage level $V_1$ to turn on the transistor $S_{n-1}$, while the scan signal on the scan line $G_n$ converts to the third voltage level $V_3$ to turn off the transistors $T_n$, $S_n$. Even though the feed-through voltage effect still affects the transistors $T_n$, $S_n$ at the time T7, the voltage of the first pixel electrode $PA_n$ is as the same as that of the second pixel electrode $PB_n$ due to voltage compensation happened prior to the time point T7 (the moment indicated by the arrow E). Accordingly, after the time point T7, the voltages on the first pixel electrode $PA_n$ and on the second pixel electrode $PB_n$ are identical, i.e. both pixel electrodes $PA_n$ and $PB_n$ of the pixel unit 110 can display the same gray level. As a result, the liquid crystal display 100 has improvement in display quality.

Figure 7:
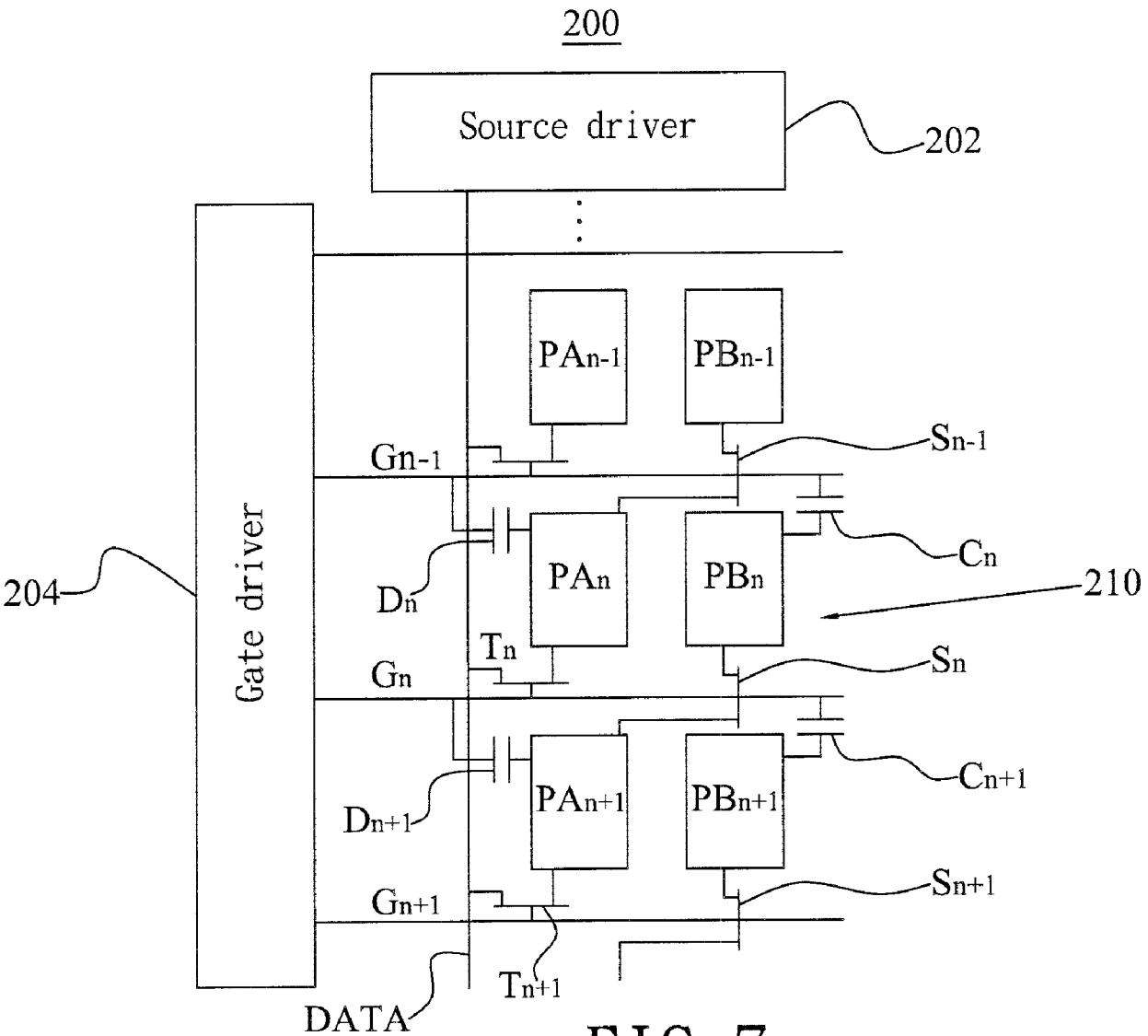
FIG. 7 is a circuit diagram of a liquid crystal display according to a second embodiment of the present invention.
Figure 8:
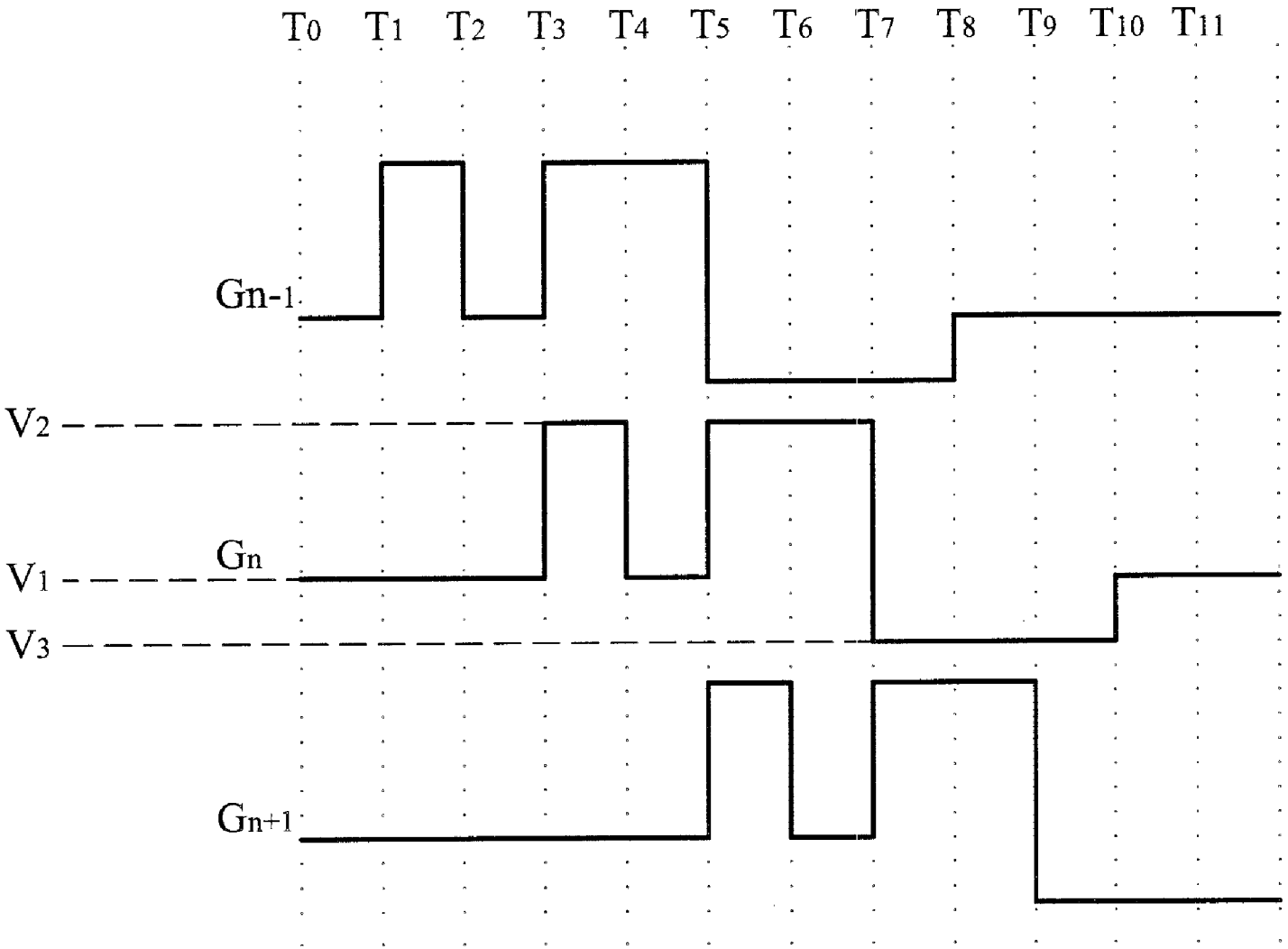
FIG. 8 is a timing diagram showing scan signals generated by the gate driver depicted in FIG. 7.

Please refer to FIG. 7 and FIG. 8. FIG. 7 is a circuit diagram of a liquid crystal display 200 according to a second embodiment of the present invention. FIG. 8 is a timing diagram showing scan signals generated by the gate driver depicted in FIG. 7. A liquid crystal display 200 comprises a source driver 202, a gate driver 204 and a plurality of the pixel units 210. The plurality of pixel units 210 are arranged in an array. Each pixel unit 210 comprises a first pixel electrode $PA_n$, a second pixel electrode $PB_n$, a first transistor $T_n$, a second transistor $S_n$, a first level adjustment unit and a second level adjustment unit. The gate driver 204 can generate a scan signal in characteristic of at least three voltage levels which a second voltage level $V_2$ is greater than a first voltage level $V_1$, and a third voltage level $V_3$ is less than the first voltage level $V_1$. The first and second level adjustment units can be a capacitor $C_n$, and a capacitor $D_n$ respectively.

Figure 9:
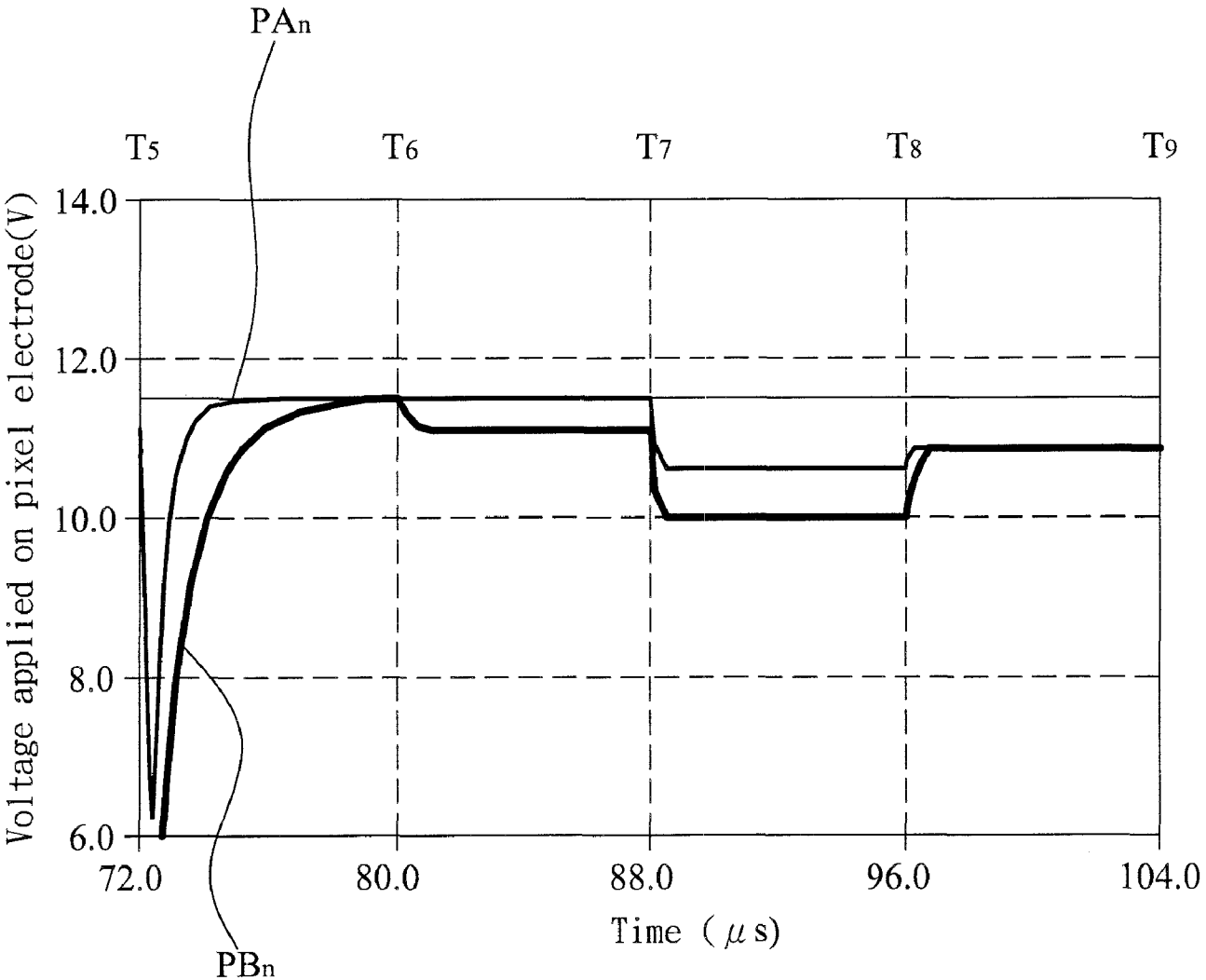
FIG. 9 illustrates a relationship of voltages applied on the first pixel electrode $PA_n$ and the second pixel electrode $PB_n$ of the pixel unit depicted in FIG. 4.

With reference from FIG. 7 to FIG. 9, FIG. 9 illustrates a relationship of voltages applied on the first pixel electrode $PA_n$ and the second pixel electrode $PB_n$ of the pixel unit depicted in FIG. 4. First, in the time period T5-T6, the transistors $T_n$, $S_n$, $T_{n+1}$ are all turned on due to the scan signals at the second voltage level $V_2$ generated by the gate driver 204 through the scan lines $G_n$, $G_{n+1}$. Meanwhile, the scan signal on the scan line $G_{n-1}$ is at the third voltage level $V_3$, so the transistor $S_{n-1}$ is turned off. Therefore, data signal generated from the source driver 102 is delivered to the first pixel electrodes $PA_n$ and $PA_{n+1}$ via data line DATA, and charges the second pixel electrode $PB_n$ since the transistor $S_n$ is turned on. As such the first pixel electrode $PA_n$ and the second pixel electrode $PB_n$ are simultaneously fed by the same data signal. At the same time, the storage capacitors $C_n$, $D_n$ are charged due to a voltage difference across their two ends.

In the time period T6-T7, the scan signal on the scan line $G_n$ remains at the second voltage level $V_2$ to switch on the transistors $T_n$, $S_n$, whereas the scan signal on the scan line $G_{n+1}$ is switched to the first voltage level $V_1$, thereby turning off the transistor $T_{n+1}$. As can been seen in FIG. 9, at the time point T6, a voltage drop of the second pixel electrode $PB_n$ is induced by a feed-through voltage effect. At this moment, the first pixel electrode $PA_n$ still receives the data signal without the feed-through voltage effect.

Next, in a time period T7-T8, the scan signal $G_{n-1}$ is at the third voltage level $V_3$ to turn off the transistor $S_{n-1}$. Noted that, at the time T7, even though the scan signal on the scan line $G_n$ is varied from the second voltage level $V_2$ to the third voltage level $V_3$, causing the transistors $T_n$, $S_n$ turning off, an identical drop of voltages applied on the first pixel electrode $PA_n$ and the second pixel electrode $PB_n$ happens due to parasitic capacitance of the transistor. However, the voltage applied on the second pixel $PB_n$ drops at the time T6, so the voltages applied on the first pixel $PA_n$ and the second pixel $PB_n$ are different at the time T7.

At the time T8, the scan signal on the scan line $G_{n-1}$ is varied from the third voltage level $V_3$ to the first voltage level $V_1$, while the scan signal on the scan line $G_n$ remains at the third voltage level $V_3$, causing the transistors $S_{n-1}$, $T_n$, $S_n$ turning off. In other words, at the time T8, because the scan signal on the scan line $G_{n-1}$ is varied from the third voltage level $V_3$ to the first voltage level $V_1$, and charge stored in the respective capacitors $C_n$, $D_n$ is constant, the voltages of the first pixel electrode $PA_n$ and the second pixel electrode $PB_n$ raise as a rise of voltage level of the scan signal on the scan line $G_{n-1}$. Despite the voltages applied on the first pixel electrode and the second electrode are not identical in the time period T7-T8, proper selected capacitances of capacitors $C_n$, $D_n$ can adjust the voltage of the first pixel electrode $PA_n$ as the same as that of the second pixel electrode $PB_n$ at the time T8. Consequently, after the time point T8, the voltages on the first pixel electrode $PA_n$ and on the second pixel electrode $PB_n$ are identical, i.e. both pixel electrodes $PA_n$ and $PB_n$ of the pixel unit 210 can display the same gray level. As a result, the liquid crystal display 200 has improvement in display quality Compared with prior art, the liquid crystal display of the present invention utilizes a scan signal with three voltage levels and provides capacitors coupling to pixel electrodes of a pixel unit, to compensate the voltage differences of the pixel electrodes of the pixel unit resulting from the feed-through voltage. In this way, all pixel units of the liquid crystal display can improve in display quality.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A liquid crystal display (LCD) comprising a gate driver for generating scan signals, the scan signals comprising a first voltage level, a second voltage level greater than the first voltage level, and a third voltage level less than the first voltage level;

a source driver for generating data signals;

a plurality of scan lines comprising a first scan line, a second scan line, and a third scan line, for delivering the scan signals;

a plurality of data lines comprising a first data line for delivering the data signals;

a plurality of pixel units arranged in an array, each pixel unit comprising:

a first pixel electrode;

a first transistor, electrically coupling the first pixel electrode, the first data line, and the second scan line, for conducting the data signals from the first data line to the first pixel electrode when the scan signal from the second scan line is at the second voltage level;

a second pixel electrode;

a second transistor, electrically coupling the second pixel electrode and a first pixel electrode of a pixel unit which is electrically coupled to the third scan line and the first data line, for conducting the data signals, through the first pixel electrode of the pixel unit which is electrically coupled to the third scan line and the first data line, to the second pixel electrode, when scan signals from the second scan line and the third scan line are at the second voltage level; and a level adjustment unit directly connected to the second pixel electrode and directly connected to the first scan line, for adjusting a voltage applied on the second pixel electrode, when the scan signal from the second scan line is at the second voltage level, and when a scan signal from the first scan line is varied from the third voltage level to the first voltage level.

2. The liquid crystal display of claim 1, wherein the level adjustment unit is a capacitor.

3. The liquid crystal display of claim 2, wherein the level adjustment unit is used for adjusting the voltage applied on the second pixel electrode in response to a capacitance of the level adjustment unit, when the scan signal from the second scan line is at the second voltage level, and when the scan signal from the first scan line is varied from the third voltage level to the first voltage level.

4. The liquid crystal display of claim 2, wherein the level adjustment unit is charged, when the scan signal from the second scan line is at the second voltage level, and the scan signal from the first scan line is at the third voltage level.

5. A liquid crystal display, comprising:

a gate driver for generating scan signals, the scan signals comprising a first voltage level, a second voltage level greater than the first voltage level, and a third voltage level less than the first voltage level;

a source driver for generating data signals;

a plurality of scan lines comprising an first scan line, an second scan line, and an third scan line, for delivering the scan signals;

a plurality of data lines comprising a first data line for delivering the data signals;

a plurality of pixel units arranged in an array, each pixel unit comprising:

a first pixel electrode;

a first transistor, electrically coupling the first pixel electrode, the first data line and the second scan line, for conducting the data signals from the first data line to the first pixel electrode when the scan signal from the second scan line is at the second voltage level;

a second pixel electrode;

a second transistor, electrically coupling the second pixel electrode and a first pixel electrode of a pixel unit which is electrically coupled to the third scan line and the first data line, for conducting the data signals through the first pixel electrode of the pixel unit which is electrically coupled to the third scan line and the first data line, to the second pixel electrode, when the scan signals from the second scan line and the third scan line are at the second voltage level;

a first level adjustment unit directly connected to the second pixel electrode and directly connected to a gate of a second transistor of the pixel unit which is electrically coupled to the first scan line and the first data line, for adjusting the voltage applied on the second pixel electrode, when the scan signal from the second scan line is at the third voltage level, and when a scan signal from the first line is varied from the third voltage level to the first voltage level; and a second level adjustment unit for adjusting the voltage applied on the first pixel electrode, when the scan signal from the second scan line is at the third voltage level, and when the scan signal from the first scan line is varied from the third voltage level to the first voltage level.

6. The liquid crystal display of claim 5, wherein the first level adjustment unit is a capacitor.

7. The liquid crystal display of claim 6, wherein the first level adjustment unit is used for adjusting the voltage applied on the second pixel electrode in response to a capacitance of the first level adjustment unit, when the scan signal from the second scan line is at the third voltage level, and when the scan signal from the first scan line is varied from the third voltage level to the first voltage level.

8. The liquid crystal display of claim 6, wherein the first level adjustment unit is charged, when the scan signal from the second scan line is at the second voltage level, and the scan signal from the first scan line is at the third voltage level.

9. The liquid crystal display of claim 5, wherein the second level adjustment unit is coupled to the first pixel electrode and a gate of the second transistor of the pixel unit which is electrically coupled to the first scan line and the first data line.

10. The liquid crystal display of claim 9, wherein the second level adjustment unit is a capacitor.

11. The liquid crystal display of claim 10, wherein the second level adjustment unit is used for adjusting the voltage applied on the first pixel electrode in response to a capacitance of the second level adjustment unit, when the scan signal from the second scan line is at the third voltage level, and when the scan signal from the first scan line is varied from the third voltage level to the first voltage level.

12. The liquid crystal display of claim 9, wherein the second level adjustment unit is charged, when the scan signal from the second scan line is at the second voltage level, and the scan signal from the first scan line is at the third voltage level.

13. A method of driving a liquid crystal display, the liquid crystal display comprising a plurality of scan lines, a plurality of data lines, and a plurality of pixel units arranged in an array, the plurality of scan lines comprising a first scan line, a second scan line, and a third scan line, the plurality of data lines comprising a first data line, each pixel unit comprising a first pixel electrode and a second pixel electrode, the method comprising:

providing scan signals, the scan signals comprising a first voltage level, a second voltage level greater than the first voltage level, and a third voltage level less than the first voltage level;

conducting the data signal to the second electrode of a pixel unit which is electrically coupled to the second scan line and the first data line, through a first pixel electrode of a pixel unit which is electrically coupled to the first scan line and the first data line to the second pixel electrode, when the scan signals from the second scan line and the third scan line are at the second voltage level; and adjusting a voltage applied on the second pixel electrode in response to a capacitance of a capacitor directly connected to the first scan line and directly connected to the second pixel electrode of the pixel unit which is electrically coupled to the second scan line and the first data line, when the scan signal from the second scan line is at the second voltage level, and when the scan signal from the first scan line is varied from the third voltage level to the first voltage level.

14. The method of claim 13, further comprising:

transmitting data signals to the first pixel electrode of the pixel unit which is electrically coupled to the second scan line and the first data line, when the scan signal from the second scan line is at the second voltage level.

15. The method of claim 13, further comprising:

charging the capacitor, when the scan signal from the second scan line is at the second voltage level, and when the scan signal from the first scan line is at the third voltage level.

16. A method of driving a liquid crystal display, the liquid crystal display comprising a plurality of scan lines, a plurality of data lines, and a plurality of pixel units arranged in an array, the plurality of scan lines comprising a first scan line, a second scan line, and a third scan line, the plurality of data lines comprising a first data line, each pixel unit comprising a first pixel electrode and a second pixel electrode, the method comprising:

providing scan signals, the scan signals comprising a first voltage level, a second voltage level greater than the first voltage level, and a third voltage level less than the first voltage level;

conducting the data signal to the second electrode of a pixel unit which is electrically coupled to the second scan line and the first data line, through a first pixel electrode of a pixel unit which is electrically coupled to the first scan line and the first data line to the second pixel electrode, when the scan signals from the second scan line and the third scan line are at the second voltage level; and adjusting voltage applied on the first pixel electrode via a second capacitor directly connected to the first pixel electrode and directly connected to a gate of the second transistor which is electrically coupled to the first scan line and the first data line, and adjusting voltage applied on the second pixel electrode directly connected to the second pixel electrode and directly connected to a gate of a second transistor of the pixel unit which is electrically coupled to the first scan line and the first data line, when the scan signal from the second scan line is at the second voltage level, and when the scan signal from the first scan line is varied from the third voltage level to the first voltage level.

17. The method of claim 16, wherein the capacitance of the first capacitor and the capacitance of the second capacitor are different.

18. The method of claim 17, further comprising:

transmitting data signals to the first pixel electrode of the pixel unit which is electrically coupled to the second scan line and the first data line, when the scan signal from the second scan line is at the second voltage level.

19. The method of claim 16, further comprising:

charging the first and the second capacitors, when the scan signal from the second scan line is at the second voltage level, and when the scan signal from the first scan line is at the third voltage level.

* * * * *